US006171427B1

(12) United States Patent
Hess et al.

(10) Patent No.: US 6,171,427 B1
(45) **Date of Patent: *Jan. 9, 2001**

(54) HIGH SPEED CORRUGATOR SINGLE FACER WITH STEAM INJECTION

(75) Inventors: David W. Hess, Madison; Gale G. Hoyer; Carl R. Marschke, both of Phillips; Keith R. Kornuth, Catawba, all of WI (US)

(73) Assignee: Marquip, Inc., Phillips, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/088,215

(22) Filed: Jun. 1, 1998

(51) Int. Cl.[7] ..... B31F 1/20
(52) U.S. Cl. ..... 156/208; 156/210; 156/472
(58) Field of Search ..... 261/DIG. 76, DIG. 10; 156/471, 472, 205, 208, 210, 462, 470, 499, 320; 493/463

(56) References Cited

U.S. PATENT DOCUMENTS

| | | | | |
|---|---|---|---|---|
| 2,102,937 | | 12/1937 | Bauer | 134/23.4 |
| 2,487,647 | | 11/1949 | Goettsch | 154/32 |
| 2,987,105 | | 6/1961 | Gebbie | 154/32 |
| 3,097,994 | * | 7/1963 | Dickens et al. | 162/297 |
| 3,394,041 | | 7/1968 | De Ligt | 156/548 |
| 3,434,901 | * | 3/1969 | Griffiths et al. | 156/210 |
| 3,690,981 | | 9/1972 | De Frank et al. | 156/210 |
| 3,849,224 | * | 11/1974 | Hintz et al. | 156/208 |
| 3,857,514 | * | 12/1974 | Clifton | 239/132 |
| 4,134,781 | | 1/1979 | Carstens et al. | 156/64 |
| 4,140,564 | | 2/1979 | Schrader | 156/205 |
| 4,419,173 | * | 12/1983 | Akiyama et al. | 156/470 |
| 4,589,944 | | 5/1986 | Torti et al. | 156/285 |
| 4,655,870 | | 4/1987 | Mori et al. | 156/285 |
| 5,244,518 | * | 9/1993 | Krayenhagen et al. | 156/64 |
| 5,344,520 | * | 9/1994 | Seki et al. | 156/472 |

* cited by examiner

*Primary Examiner*—Michael W. Ball
*Assistant Examiner*—Gladys Piazza
(74) *Attorney, Agent, or Firm*—Andrus, Sceales, Starke & Sawall

(57) ABSTRACT

A method and apparatus for producing a single face corrugated web in which a steam cloud is injected between the corrugated medium web and the liner web directly at the line along which the webs converge. This type of steam injection allows faster corrugator speeds without sacrificing bonding quality. An adhesive slurry of water and starch granules is applied to the flute tips to form glue lines on the corrugated web prior to the convergence of the webs. The injected steam cloud directed at the web convergence line adds heat without promoting premature dehydration to facilitate proper conditions for effective cooking of the adhesive slurry to thoroughly gelatinize the adhesive. In some applications, dry steam is preferred because dry steam does not significantly interfere with subsequent dehydration of the adhesive gel during the formation of the initial green bond.

20 Claims, 3 Drawing Sheets

FIG. 1
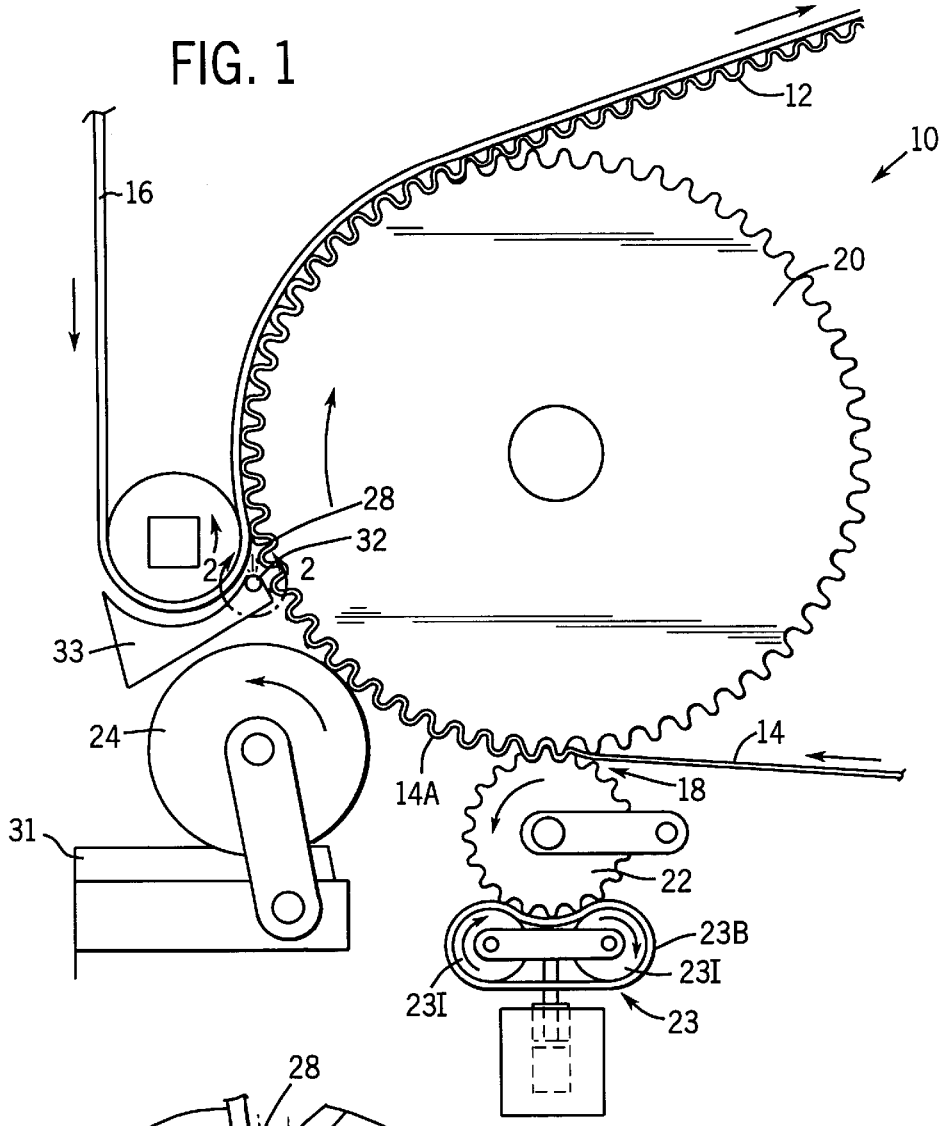
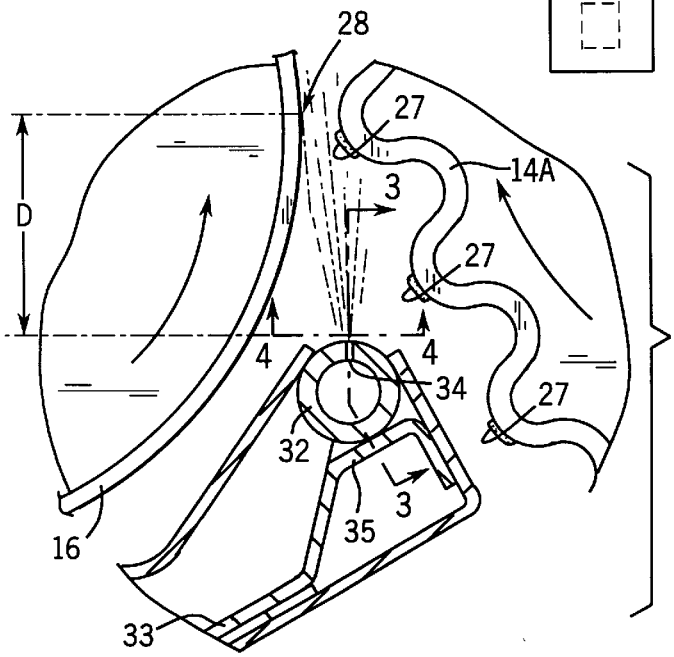
FIG. 2

HIGH SPEED CORRUGATOR SINGLE FACER WITH STEAM INJECTION

FIELD OF THE INVENTION

The invention relates to the manufacturing of corrugated paperboard, and more particularly to the use of steam injection to allow higher production speeds without sacrificing adhesive bonding quality.

BACKGROUND OF THE INVENTION

In the manufacturing of corrugated paperboard, a single facer apparatus is used to flute the medium web, to apply adhesive (e.g. starch adhesives) to the flute tips on one of the faces of the medium web, and to bring a liner web into contact with glue lines on the flute tips of the medium web with the application of heat downstream to form the initial bond. Many manufacturers in the art use high-pressure (e.g. 20,000 lbs. of force) at the bonding nip where the liner web is introduced to the flute tips on the medium web. Others use less pressure at the bonding nip. The assignee of this application produces a single facer in which the liner roll introducing the liner web to the fluted medium web is spaced apart from the fluted surface of the bonding roll. The present invention involves the use of steam injection at the convergence of the webs to improve the formation of adhesive bonds between the liner web and the flute tips on the medium web, especially at relatively high production speeds (e.g. 1300 feet per minute). It is particularly useful on single facers that do not have a high pressure bonding nip.

When applied to the flute tips on the medium web, the starch adhesive consists of a slurry of starch granules in water (e.g. an aqueous-based starch adhesive). In order to achieve optimum bond strength, it is desirable that the water and starch granule slurry first gelatinize into a viscous gel. In order to gelatinize the starch adhesive, the adhesive slurry must be heated to a temperature of at least 150° F. for a sufficient amount of time. It is therefore known in the art to preheat the liner web to promote gelatinization of the adhesive, preferably to about 180° to 212° F. The viscous gel does not have significant bond strength until dehydration occurs. However, if dehydration occurs prematurely before gelatinization, the resulting bond will be poor.

It is important that the initial green bonds formed on the single facer between the liner web and the flute tips of the medium web have sufficient strength to withstand further processing downstream in the corrugator. Although green bond formation begins immediately at about 200° F., substantial dehydration of the glue line and adjoining web surfaces must occur before adequate green bond strength is realized. The medium web is heated on the bonding roll preferably to about 215° F. to facilitate dehydration and formation of the green bond. In order to achieve sufficient heat transfer, the bonding roll surface temperature should be at about 375° F. or more. As more heat is added to evaporate moisture, the bond strength continues to increase. A fully cured bond is finally obtained when most of the water is evaporated (e.g. approximately 80%).

As production speed increases, exposure times for gelatinization and green bond formation are proportionally reduced at the same time that the level of mechanical stress imposed on the freshly bonded corrugated web are increased. Heretofore, it has been difficult to increase production speeds above, for example, 1,000 feet per minute without sacrificing bond quality.

SUMMARY OF THE INVENTION

The invention promotes high speed corrugator production without sacrificing adhesive quality by injecting a steam cloud between the fluted medium web on a single facer bonding roll and the liner web directly at the line along which the webs converge. The direct application of the steam cloud provides additional heat to the glue lines on the flute tips without causing premature dehydration to facilitate appropriate gelatinization of the adhesive, and also promote sufficient green bond formation between the flute tips on the medium web and the liner web as the composite single face web is carried downstream on the bonding roll. Steam injection is a particularly effective means for additional heat because of the latent heat associated with the phase change of steam upon condensation. In addition, injected steam heating can be controlled virtually instantaneously.

The invention is preferably implemented using an elongated steam shower tube that extends generally parallel with the bonding roll and the liner roll. The elongated tube has a plurality of aligned steam discharge openings configured to produce a steam cloud that is directed at the line at which the webs converge. Preferably, the aligned steam discharge holes are located approximately 2 to 3 inches from the convergence line, thus allowing the steam cloud discharged from the aligned openings to be accurately directed at the convergence line. It has been found that applying the steam upstream of the convergence line significantly deteriorates the strength of the resulting green bond.

In many applications of the invention, it may be particularly desirable that the steam cloud consist of dry steam. Dry steam is steam in which the ratio by weight of water vapor in the steam to the combination of water vapor and suspended liquid droplets together is substantially high. By applying dry steam, excess moisture (which is present in wet steam from suspended liquid droplets) does not need to evaporate in order to achieve sufficient dehydration for initial green bond formation.

The preferred construction for a dry steam shower includes an elongated outer tube that receives the steam from the steam source, and an inner tube mounted within the outer tube. The inner tube includes steam inlet openings to allow the flow of steam into the inner tube. The dimensions of the steam inlet openings is limited, however, to restrict the flow of steam into the inner tube such that the steam pressure within the inner tube is lower than the steam pressure in the outer tube. The inner tube contains the aligned steam discharge openings that are directed at the web convergence line. In the embodiment shown in the drawings, the aligned steam discharge openings on the inner tube are exposed through a slot on the outer tube. The temperature of the steam within the inner tube is lower than the temperature of the steam within the outer tube because the pressure of the steam within the inner tube is lower than the pressure of the steam within the outer tube. The steam within the outer tube therefore heats the wall of the inner tube to a temperature greater than the temperature of the steam located within the inner tube. Because the wall of the inner tube has a temperature greater than the temperature of the steam within the inner tube, little or no condensation occurs within the inner tube and the amount of suspended liquid droplets in steam discharged from the shower is insignificant.

In another aspect, it is preferred that steam shower have an outlet that is located downstream of the aligned steam discharge openings. A normally closed valve is located at the outlet which is closed during normal operation so that steam flows through the aligned steam discharge openings. Upon system start-up, the valve is opened such that steam provided to the tube clears the tube of condensed water. This is important upon start-up so that a slug of condensed water does not blast against the webs and tear or otherwise damage the webs.

In the preferred embodiment of the invention, the liner roll does not apply pressure against the bonding roll at the convergence of the two webs. Such a single facer is disclosed in U.S. patent application Ser. No. 08/740,726, by Carl Marschke, filed on Nov. 1, 1996, and entitled "Low Pressure Single Facer" (See, e.g., page 10). However, the invention is likely to be useful in single facers having a low-pressure bonding nip or other configurations in which additional heat at the web convergence line are desired. In some aspects, the invention may be useful to promote bonding on other corrugator components, such as injecting dry steam on a double backer.

Subsequent to the web convergence line on the bonding roll, the liner web is maintained in substantial contact with the flute tips on the medium web by the tension of the liner web as the composite web is carried on the heated bonding roll. The liner web is maintained in contact with the flute tips on the medium web on the bonding roll for an amount of time at least sufficient to allow appropriate green bond formation from the gelatinized adhesive. Preferably, the bonding roll is heated at approximately 375° to promote effective formation of the green bond.

It should be apparent to those skilled in the art that the invention is particularly usefull for facilitating proper gelatinization of adhesive and green bond formation at high corrugator production speeds when using starch-based adhesives (e.g. cornstarch adhesive). It should further be appreciated by those skilled in the art that the invention is not limited to conventional starch-based adhesives. Any adhesive whose performance is affected by the phenomena of drying and/or heating could likely be employed in variations of the present invention.

Other features, advantages and variations of the invention should be apparent to those skilled in the art upon inspecting the drawings and the following description thereof.

BRIEF DESCRIPTION OF THE DRAWINGS

FIG. 1 is a side elevational view of a corrugator single facer having a steam shower that injects a steam cloud between a corrugated medium web and a liner web at the convergence of the webs as in accordance with the invention.

FIG. 2 is a detailed view of the area outlined by line 2—2 in FIG. 1.

DETAILED DESCRIPTION OF THE DRAWINGS

Figure 3:
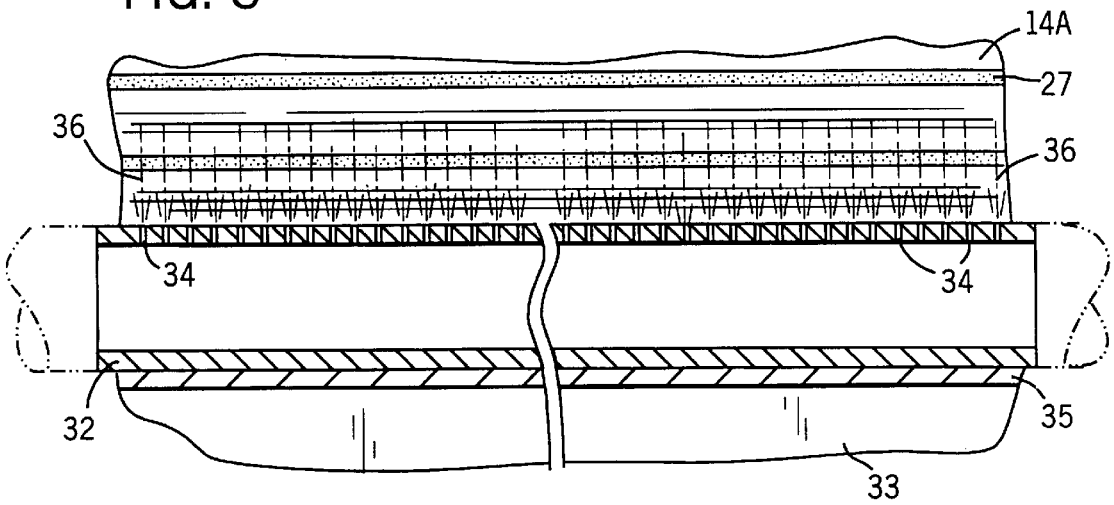
FIG. 3 is a sectional view taken along line 3—3 in FIG. 2.

Referring to FIG. 1, a single facer 10 operates to form a composite single face web 12 from a medium web 14 and a liner web 16, which function is generally characteristic of prior art single facers. The incoming medium web 14 is directed into a corrugating nip 18 defined by inter-engaging flutes on the circumference of a bonding roll 20 and on the circumference of a corrugating roll 22. The medium web 14 is deformed in the corrugating nip 18 to provide the characteristic flutes of the medium web 14*a*. A detailed description of the inter-engaging flutes on the circumference of the bonding roll 20 and on the circumference of the corrugating roll 22 is disclosed in copending U.S. patent application Ser. No. 09/044,561, by Carl R. Marschke, filed on Mar. 19, 1998 and entitled "Single Facer With Small Intermediate Corrugating Roll And Variable Wrap Arm Device"; and copending U.S. patent application Ser. No. 08/854,953, filed on May 13, 1997 by Carl R. Marschke, entitled "Improved Single Facer With Small Intermediate Corrugating Roll", both incorporated herein by reference. Briefly, the corrugating roll 22 is relatively small compared to the bonding roll 20. Deflection of the corrugating roll 22 is preferably controlled by a plurality of belted backing roll arrangements 23. Each arrangement 23 includes a pressure belt 23*b* around idler rollers 23*i* which are pneumatically mounted to the single facer structure. The belt 23*b* may be fluted to match the fluted surface of the small corrugating roll 22. The arrangements 23 supply a backing force along the entire axial length of the small diameter corrugating roll 22. Since each of the backing roll arrangements 23 includes its own pneumatic cylinder, each backing roll arrangement can be configured to operate independently such that the backing force is varied along the axial length of the small diameter corrugating roll 22.

Figure 4:
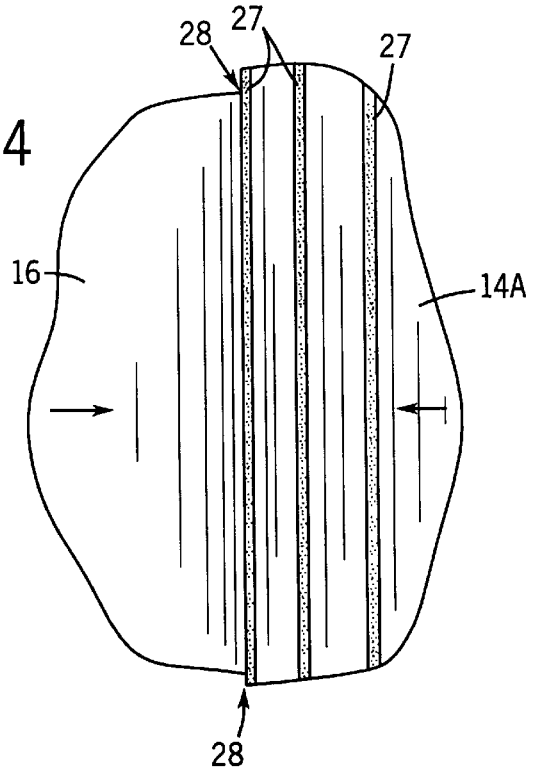
FIG. 4 is a view taken along line 4—4 in FIG. 2.

Downstream of the corrugating nip 18, the fluted medium web 14*a* wraps around the corrugated surface of the bonding roll 20. As the bonding roll 20 carries the fluted medium web 14 around its circumference, the flute tips of the corrugated medium web 14*a* are contacted by a rotating glue applicator roll 24. The glue applicator roll 24 applies a layer of aqueous starch-based adhesive to the flute tips on the medium web 14*a* to create continuous glue lines 27 (See FIGS. 2–4) along the flute tips. The aqueous starch-based adhesive is preferably stored in a glue pan 31 prior to being applied to the flute tips by the rotating glue application roller 24. The aqueous starch-based adhesive typically consists as a water and starch granule slurry in the glue pan 31, and when the adhesive is initially applied to create continuous glue lines along the flute tips on the medium web 14*a*. Just after the glue applicator roll 24, the liner web 16 is brought tangentially into contact with the glued flute tips of the corrugated medium web 14*a* at a web bonding convergence line 28. Prior to the web bonding convergence line 28, the liner web 16 is wrapped around the circumference of a liner roll 26. The liner roll 26 is preferably preheated to heat the liner web 16 to a temperature sufficiently higher than the gelatinization temperature of the adhesive (i.e., above about 150° F.), preferably to about 180 ° and 212° F. Alternatively, preheating plates can be used upstream of the liner roll 26. As will be appreciated by those skilled in the art, any method of conventional preheating, whether by roll, hot air, steam shower, radiant energy, or other known source, may be employed in preheating the liner web 16, or it may be found that preheating is not required in particular applications.

Preferably, the liner roll 26 is spaced from the fluted outer surface of the bonding roll 20 by a distance sufficient to preclude any significant nip pressure on the joined webs 14*a* and 16. At the web bonding convergence line 28, the preheated liner roll 26 is preferably spaced by a distance at least as great as the combined thickness of the liner web 16 and the corrugated medium web 14*a*. Thus, there should be no stress applied to either the liner web 16 or the corrugated medium web 14*a*, and the chance of tearing either of the two webs 16, 14*a* should therefore be greatly reduced. In addition, the glue line 27 at the flute tips on the medium web 14*a* are not squeezed to displace moisture prematurely from the adhesive.

After the liner web 16 is initially introduced to the fluted medium web 14*a* on the bonding roll 20 along the convergence line 28, the composite webs 14*a*, 16 are subsequently carried on the bonding roll 20 together until the composite single face web 12 is transferred from the bonding roll 20 for further processing downstream in the corrugator. The bonding roll 20 is preferably heated to approximately 375° F. to promote dehydration of the adhesive and formation of a green bond having sufficient strength to withstand further processing downstream in the corrugator. If desired, a variable wrap arm device such as disclosed in copending U.S. patent application Ser. No. 09/044,516, filed on Mar. 19, 1998, by Carl R. Marschke, entitled "Single Facer With Small Intermediate Corrugating Roll And Variable Wrap Arm Device", incorporated herein by reference, may be used to lengthen the time in which the composite webs 14*a*, 16 are in contact with the bonding roll 20 subsequent to convergence of the webs on the bonding roll 20.

In accordance with the primary aspect of the invention, a steam shower 30 injects a steam cloud 36 between the fluted medium web 14*a* on the bonding roll 20 and the liner web 16 introduced from the liner roll 26. The steam cloud 36 is injected directly at the web convergence line 28. The steam shower 30 provides additional heat and moisture to the glue lines 27 on the flute tips at the web convergence line 28, but does not promote premature dehydration. The steam cloud 36 therefore promotes proper gelatinization of the adhesive between the flute tips on the corrugated medium web 14*a* and the liner web 16, as well as efficient green bond formation thereafter.

Referring now in particular to FIGS. 2–5, a typical form for the steam shower 30 is an elongated tube 32 mounted generally in parallel with the bonding roll 20 and the liner roll 26. The elongated tube 32 preferably extends transversely across the single facer 10 at least the width of the medium web 14*a* on the bonding roll 20. The elongated tube 32 is mounted in place using mounting bracket 33. The tube 32 is secured tightly within the walls 35 of the bracket 33. The mounting bracket 33 may be constructed integrally with a water-cooled glue shield as is shown in the drawings. The elongated steam shower tube 32 contains a plurality of aligned steam discharge openings 34 that are directed at the web convergence line 28, see FIG. 2. The preferred inside diameter of the elongated tube 32 is approximately 0.5 to 1.5 inches, and the preferred outside diameter of the tube 32 is approximately 0.75 to 1.75 inches. It is desirable that the diameter of the aligned steam discharge openings be sufficiently small, preferably 0.04 to 0.05 inches, to provide a steam cloud or mist without substantial kinetic energy that is likely to deteriorate the applied glue lines 27 on the flute tips before bonding. It is also desirable that the steam cloud 36, FIG. 3, be relatively uniform over the transverse width of the web. Therefore, the aligned steam discharge openings 34 are preferably spaced apart evenly about ¼ to ⅓ of an inch from each other along the length of the tube 32.

Figure 5:
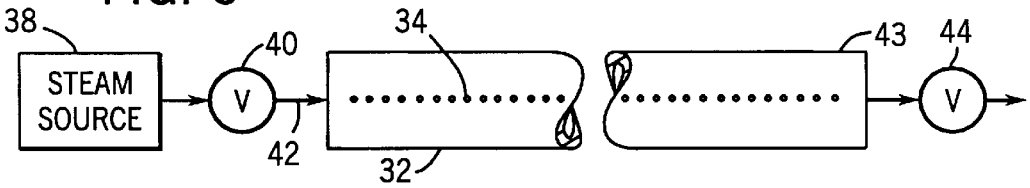
FIG. 5 is a view showing the preferred construction of a steam shower used in accordance with the invention.

Steam is provided to the elongated steam shower tube 32 from a source 38, FIG. 5, of pressurized steam, for example 150 psia. A variable flow control valve 40 can be provided in a steam supply conduit 42 between the steam source 38 and the team shower 32 to adjust the steam pressure within the tube 32 as appropriate.

Using steam at 150 psia, it has been found desirable to place the aligned steam discharge openings 34 of the elongated steam shower tube 32 at a distance D from the web convergence line 28, see FIG. 2, in the range of 2 to 3 inches. With the above-described configuration, the steam cloud 36 is injected directly towards the web convergence line 28 without deteriorating the glue lines 27 on the flute tips of the corrugated medium web 14*a*. The steam cloud 36 provides additional heat to the adhesive immediately prior to initial contact between the fluted medium web 14*a* and the liner web 16, and, therefore effectively promotes thorough gelatinization of the starch adhesive. In many applications, the injection of the steam cloud 36 from the steam shower 32 shown in FIGS. 2, 3 and 5, does not have a significant adverse affect on the dehydration process, especially if the bonding roll 20 is heated to approximately 375° F.

Referring now in particular to FIG. 5, the elongated steam shower tube 32 preferably includes an outlet 43 that is located downstream of the aligned steam discharge openings 34. A normally closed valve 44 is located at the outlet 43. The valve 44 is closed during normal operation so that steam flows through the aligned steam discharge openings 34. On the other hand, the valve 44 is opened at system startup to clear the elongated steam shower tube 32 of condensed water, thereby preventing a slug of condensed water from discharging through the openings 34 against the webs 16, 14*a*.

Figure 6A:
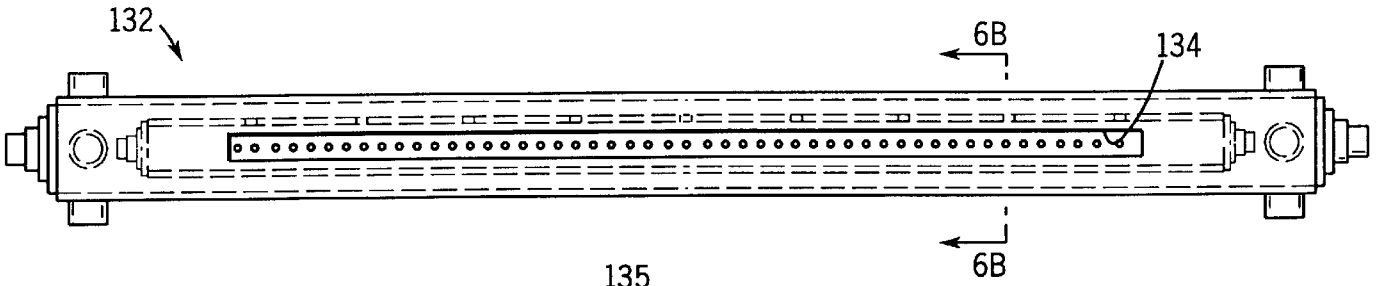
FIGS. 6*a* through 6*c* show a dry steam shower in accordance with the invention.
Figure 6B:
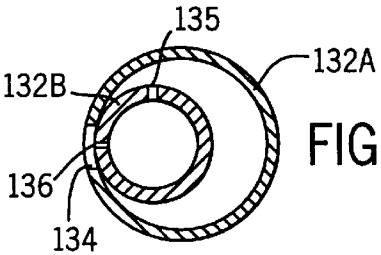
Figure 6C:
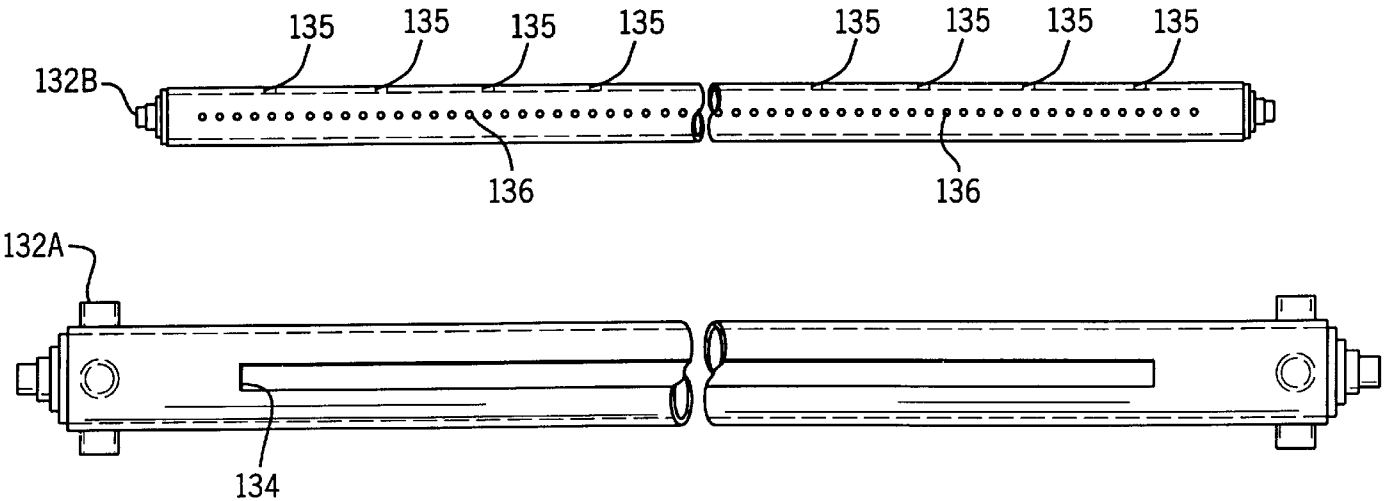

Referring now to FIGS. 6*a* through 6*c*, it may be preferred in some applications to use a steam shower that is modified to discharge dry steam, therefore reducing downstream dehydration requirements for effective green bond formation. The dry steam shower 132 in FIGS. 6*a* through 6*c* includes an outer elongated tube 132*a* and an inner elongated tube 132*b*. The outer elongated tube 132*a* includes an elongated open slot 134 that provides an opening directed at the web convergence line 28. The inner tube 132*b* is completely enclosed except for steam inlets 135 and the aligned steam discharge openings 136. The inner tube 132*b* is mounted within the outer tube 132*a* such that the aligned steam discharge openings 136*b* in the inner tube 132*b* are exposed through the elongated slot 134 in the outer tube 132*a*. The orientation and size of the aligned steam discharge openings 136 are preferably the same or similar to the mbodiment shown in FIGS. 2 through 5. In addition, the inner tube 132*b* is mounted uch that the steam inlets 135 are located at the top of the tube 132*b*. The size and the configuration of the steam inlets 135 is limited to restrict the flow of steam into the inner steam diameter within the inner tube 132*b*, e.g. openings 135 having a ¼ inch diameter and spaced apart 6 inches along the tube 132*b* have been found suitable for some applications. Under normal operating conditions, steam supplied to the outer tube 132*a* into the inner tube 132*b* through the inlet openings 135 and is discharged through the aligned steam discharge openings 136. The inlet openings 135 provide a restricted flow area such that the pressure of the steam within the inner tube 132 is less than the pressure outside of the tube 132. Thus, the temperature of the steam inside of the inner tube 132*b* is less than the temperature of the steam outside of the inner tube 132*b*. The steam outside of the inner tube 132*b* heats the wall of the inner tube 132*b*. It is therefore unlikely for condensation to form within the inner tube 132*b*. Hence, the steam discharged from the shower 132 is substantially dry and does not contain a significant amount of suspended liquid water droplets.

The invention promotes proper cooking conditions for accelerated gelatinization of the adhesive, while at the same time does not interfere with subsequent dehydration, which is needed to produce green bond strength sufficient for further processing of the newly bonded single face web 12 on the corrugator. Tests have shown that the injection of the steam cloud 36 towards the web convergence line 28 improves single facer bonding performance such that single facers achieving suitable bonding performance at a maximum speed of approximately 1000 feet per minute can obtain the same or better bonding quality at speeds greater than or equal to 1300 feet per minute when using the invention as disclosed.

While the invention has been disclosed in connection with certain preferred embodiments of the invention, variations and modifications of the invention may be apparent to those skilled in the art. The following claims should be interpreted to include such variations and modifications.

We claim:

1. An apparatus for forming a single face corrugated web from a fluted medium web and a liner web, the apparatus comprising:

a rotary fluted bonding roll carrying the fluted medium web;

a glue applicator that applies a starch adhesive to exposed flute tips on the fluted medium web carried on the bonding roll, the applied adhesive forming uncured glue lines on said exposed flute tips;

a liner roll introducing the liner web to the fluted medium web on the bonding roll such that the liner web initially contacts the exposed flute tips of the medium web on the bonding roll along a web convergence line and remains substantially in contact with the flute tips downstream of the web convergence line to permit initial bond formation between the flute tips on the medium web and the liner web along the glue lines; and a steam shower that injects a steam cloud between the fluted medium web on the bonding roll and the liner web introduced from the liner roll directly at the web convergence line, thereby providing additional heat to gelatinize the starch glue lines between the flute tips on the medium web and the liner web such that substantial starch adhesive gelatinization occurs after the liner web is introduced to the fluted medium web on the bonding roll.

2. An apparatus as recited in claim 1 wherein the steam shower is a dry steam shower which discharges a steam cloud having a relatively small amount of suspended liquid.

3. An apparatus as recited in claim 1 wherein the steam shower comprises an elongated tube extending generally in parallel with the bonding roll and the liner roll, said elongated tube including a plurality of aligned steam discharge openings directed at the web convergence line.

4. An apparatus as recited in claim 3 wherein the elongated steam shower tube extends at least the transverse width of the medium web.

5. An apparatus as recited in claim 3 wherein the aligned steam tube discharge openings have a diameter of approximately 0.04 to 0.05 inches.

6. An apparatus as recited in claim 3 wherein the aligned steam discharge openings are spaced approximately ¼ of an inch from each other along the tube and each have a diameter of approximately 0.04 to 0.50 inches.

7. An apparatus as recited in claim 3 wherein the aligned steam discharge openings along the elongated steam shower tube are located 2 to 3 inches from the web convergence line.

8. An apparatus as recited in claim 3 further comprising:

a steam supply conduit that is connected to a steam inlet for the elongated steam shower tube;

an outlet for the elongated steam shower tube that is located downstream of the aligned steam discharge openings; and a normally closed valve for the outlet which is closed during normal operation so that steam flows through the aligned steam discharge openings and is opened at system start-up to clear the elongated steam shower tube of condensed water.

9. An apparatus as recited in claim 1 wherein steam supplied to the steam shower has a pressure of approximately 150 psia.

10. An apparatus as recited in claim 1 wherein the steam cloud is injected from the steam shower towards the web convergence line at a distance of 2 to 3 inches from the bonding convergence line.

11. An apparatus as recited in claim 1 wherein the bonding roll is heated to approximately 375° F.

12. An apparatus as recited in claim 1 wherein the glue applicator is a glue application roll.

13. An apparatus as recited in claim 1 wherein the liner web is maintained in substantial contact with the flute tips on the medium web by pressure which is limited to forces imposed by the wrapping of the liner web against the flute tips on the medium web around the bonding roll downstream of the bonding convergence line.

14. An apparatus as recited in claim 1 wherein the steam shower comprises an outer elongated tube extending generally in parallel with the bonding roll and the liner roll and an inner elongated tube located within the outer elongated tube, said outer elongated tube including an elongated slot extending longitudinally along one side of the outer tube, said elongated inner tube including a plurality of steam discharge openings which are aligned with the longitudinal slot on the outer tube and directed at the web convergence line, said elongated inner tube also including an inlet to allow steam located within the outer tube but outside of the inner tube to flow into the inner tube.

15. A method of creating a single face corrugated web from a liner web and a medium web comprising the steps of:

forming a series of flutes in the medium web by introducing the medium web into a corrugating nip;

carrying the fluted medium web circumferentially on a bonding roll;

applying starch adhesive to the exposed flute tips of the medium web while the medium web is being carried circumferentially on the bonding roll;

introducing a liner web to the fluted medium web on the bonding roll to form the single face corrugated web such that the liner web initially contacts the exposed flute tips on the medium web along a web convergence line;

injecting steam between the liner web and the fluted medium web on the bonding roll directly at the web convergence line, thereby providing additional heat to gelatinize starch adhesive on the exposed flute tips prior to bond formation between the flute tips on the medium web and the liner web and such that substantial starch adhesive gelatinization occurs after the liner web is introduced to the fluted medium web on the bonding roll; and carrying the medium web and the liner web on the bonding roll together downstream of the web convergence line, and maintaining substantial contact between the liner web and the flute tips on the medium web downstream of the web convergence line for an amount of time at least sufficient to permit initial bond formation between the flute tips on the medium web and the liner web before further processing of the single face corrugated web.

16. A method as recited in claim 15 further comprising the step of heating the medium web as the medium web is carried on the bonding roll.

17. A method as recited in claim 15 further comprising the step of providing heat to the medium web and the liner web downstream of the web convergence line to promote proper cooking of the adhesive during initial bond formation.

18. A method as recited in claim 15 wherein steam is injected towards the web convergence line at a distance of 2 to 3 inches from the bonding convergence line.

19. A method as recited in claim 15 wherein the liner web is maintained in substantial contact with the flute tips on the medium web by pressure which is limited to forces imposed by the wrapping of the liner web against the flute tips on the medium web around the bonding roll downstream of the web convergence line.

20. A method as recited in claim 15 wherein the steam injected between the liner web and the fluted medium web on the bonding roll directly at the web convergence line is dry steam having a relatively small amount of suspended liquid therein.

* * * * *